US008350494B2

(12) United States Patent
Snook et al.

(10) Patent No.: US 8,350,494 B2
(45) Date of Patent: Jan. 8, 2013

(54) FLUORESCENT LAMP DIMMING CONTROLLER APPARATUS AND SYSTEM

(75) Inventors: Joel Walter Snook, Grass Valley, CA (US); Albert Perry McBride, Grass Valley, CA (US); Christopher R Hansen, Grass Valley, CA (US); Jonathan Richards, Meadow Vista, CA (US)

(73) Assignee: GV Controls, LLC, Grass Valley, CA (US)

( * ) Notice: Subject to any disclaimer, the term of this patent is extended or adjusted under 35 U.S.C. 154(b) by 346 days.

(21) Appl. No.: 12/703,182

(22) Filed: Feb. 9, 2010

(65) Prior Publication Data

US 2010/0253244 A1 Oct. 7, 2010

Related U.S. Application Data

(60) Provisional application No. 61/207,081, filed on Feb. 9, 2009.

(51) Int. Cl.
*H05B 37/02* (2006.01)

(52) U.S. Cl. ..... 315/291; 315/297; 315/307

(58) Field of Classification Search ..... 315/291, 315/294, 297, 307, 308, 360, 362
See application file for complete search history.

(56) References Cited

U.S. PATENT DOCUMENTS

| | | | | |
|---|---|---|---|---|
| 5,757,145 | A * | 5/1998 | Johnson et al. | 315/308 |
| 6,121,734 | A * | 9/2000 | Szabados | 315/291 |
| 6,570,347 | B2 * | 5/2003 | Kastner | 315/307 |
| 2005/0001563 | A1 * | 1/2005 | Logan | 315/291 |
| 2010/0138067 | A1 * | 6/2010 | Mosebrook et al. | 700/295 |
| 2011/0187282 | A1 * | 8/2011 | Biery et al. | 315/291 |

* cited by examiner

*Primary Examiner* — Tung X Le
(74) *Attorney, Agent, or Firm* — IPxLaw Group LLP; Claude A. S. Hamrick

(57) ABSTRACT

A dimming controller and system is provided in either discrete or integrated form and includes a single electronic controller device and a dimming ballast for installation in an overhead fluorescent fixture. The system functions to sense power line changes caused by the flicking of a switch between OFF and ON and controls the light dimming accordingly. The power line changes may be either changes in mains frequency or user caused switch toggling.

20 Claims, 6 Drawing Sheets

FLUORESCENT LAMP DIMMING CONTROLLER APPARATUS AND SYSTEM

RELATED APPLICATIONS

This application claims priority to U.S. Provisional Application Ser. No. 61/207,081, filed Feb. 9, 2009, and entitled "Office and Home Fluorescent Light Dimmer", and is incorporated herein in its entirety by reference.

BACKGROUND

The present invention relates generally to fluorescent lamp light level control apparatus and systems, and more specifically to a controller apparatus for monitoring power input to fluorescent lamps via a user manipulated wall switch and a dimming ballast, and based upon a predetermined characteristic of OFF/ON cycles of the switch during a predetermined period, causing a corresponding adjustment of the control input to the ballast thus setting the light level to be output by the fluorescent lamps.

Personal light control dimmers allow users of the light sources to select a particular level of lighting for the environment in which they reside or work. The use of dimmers with incandescent lighting fixtures is well known. However, no such means has heretofore been popular for dimming fluorescent lighting fixtures although such sources are commonly used in both residential and work environments because they provide a more economical source of illumination.

Historically, fluorescent sources of illumination did not usually allow adjustment of intensity other than by selecting the number of available fixtures to be powered ON. Another approach has been to modify the AC power sine wave seen by a dimming ballast using a special phase control wall switch. This technique can distort the power to other devices connected to the switch and even effect negatively the utility transformer providing the power. More recently however, dimming ballasts have been made available which allow adjustment of the power applied to fluorescent lamps as a way to control the illumination. But the use of such dimming ballast has generally been limited to expensive control systems. There is thus a need for an economical, non power distorting apparatus or facility for allowing illumination control of fluorescent fixtures.

Among the various reasons why one would desire to have personal dimming control of overhead fluorescent lights include the desire to adjust the effects ambient lighting have on the use of computers, to compensate for incoming daylight or the lack thereof, to facilitate and enhance the ability to read printed text, and the creation of a suitable atmosphere for work.

Some people report eye strain and related symptoms due to too much, uncontrolled or excessively bright light. Others are concerned with the saving of energy, and still others believe that productivity improves when one has a choice as to how much light is actually wanted or needed. With respect to the saving of energy, having the ability to appropriately adjust lighting level can enable a typical office with two fluorescent fixtures to save up to 360 kilowatt hours of electrical power per year for a total dollar saving of approximately $50 per year while contributing to a cleaner environment.

Dimming fluorescent lights is different from dimming incandescent lights and requires two components and requires a dimming ballast in the overhead fixtures and a device with which to control the ballast so that it causes the lamps to generate a desired light level. Although dimming ballasts have been available for some time and the cost thereof is being significantly reduced every year, the control problem has been the principal stumbling block in the enablement of this facility in the home and office.

The lighting industry has in the recent past been providing elaborate solutions featuring daylight sensors, automated control scenarios, standardized control wiring and message protocols, these solutions, when seen from an installation and maintenance point of view, rival the intricacies of the PC networks used in most offices today. So even though available, such solutions prove to be quite costly and usually must be applied to a whole office suite to justify the architectural design expense. In addition, they require the installation of additional wiring infrastructure which normally disrupts the work place during the installation and has a high likelihood of causing a significant maintenance concern following installation.

The sophistication and complexity of available systems for the workplace may also require significant education of each employee as to how to properly use the system. Due to such cost and complexity issues, the likely addition of the enhanced lighting systems in new buildings is less than 1%, and is virtually 0% in existing or older buildings.

Present day systems for dimming or otherwise adjusting ambient light levels may certainly be achieved by lighting designers and architects, but dealing with the issues mentioned above may require a full fledged project resulting in significant investment in money, time and employee training on the part of the user.

Daylighting is one example of complexity wherein roof top or window based sensors are installed which measure outside light intensity and communicate information to an installed control system which, in turn, automatically adjusts the office lighting to a predetermined specified level to save or consume energy.

Building occupancy sensors are another popular input to the lighting control system which requires commissioning rules to be established. A central computer or each employee's personal computer may be used to control a lighting zone. This requires installation and configuration of a PC resident application on each employee PC. These lighting browsers are yet another complication, and as the seating arrangements for employees change, the applications have to be reconfigured.

These elaborate solutions and the costly and cumbersome sheetrock based changes to the walls of an existing structure to facilitate rewiring significantly increase the time and cost required for installation. This issue has restricted the above mentioned lighting control solutions, for the most part, to new building construction. While a professional design or the redesign of a building's lighting control system is the top end choice, the total cost of incorporating such systems is prohibitive for most companies.

It is therefore an objective of the present invention to provide a new solution to the above mentioned problems which eliminates the excessive cost, complexity and maintenance issues while at the same time providing the user with most if not all of the benefits.

SUMMARY

Briefly, a presently preferred embodiment of the present invention includes a combination of a novel low power controller and a dimming ballast which can easily be installed in new fluorescent lamp fixtures before installation, or be retrofitted into existing fixtures in situ. A dimming controller and ballast provided in accordance with the present invention does not require a designer or any new wiring, or sheetrock modification. It requires about 15 minutes of install time per fixture, uses the existing user switches and requires minimal if any ceiling access for installation, yet provides users with complete dimming control of the overhead lighting. It requires almost no user training and its operating instructions are described in a simple instructional sticker placed on the wall light switch.

Controlling the dimming is easily accomplished by flicking the existing light wall switch OFF and ON to a predefined sequence which will momentarily interrupt the power applied to a fixture, the illumination of which is to be adjusted. The controller includes a means for sensing certain characteristics of the power interruptions, and in response causes the ballast to be correspondingly controlled to change the power applied to the lamps, thus adjusting the level of illumination provided thereby. After the light level is adjusted to a preferred setting, the device remembers the setting for the next time the lights are turned on.

An important advantage of the present invention is that it is designed to simply monitor the power line that runs from the light switch to the fluorescent fixture.

Another advantage of the present invention is that it provides easy control of fluorescent light levels via operation of an existing ON/OFF wall switch.

Still another advantage of the present invention is that the apparatus can be installed in old or new buildings and homes at minimal cost because no changes are needed to the wall wiring between switch and lamp fixture.

Yet another advantage of the present invention is that the new controller apparatus is compatible with most dimming ballasts which support the 0-10 volt standard for dimming levels.

A still further advantage of the present invention is that no commissioning or setup is needed beyond installing the apparatus in the lamp fixture.

These and other objects and advantages of the present invention will no doubt become apparent to those of ordinary skill in the art following a reading of the detailed description of the embodiments illustrated in the several figures of the drawing.

IN THE DRAWING

DETAILED DESCRIPTION

Figure 1:
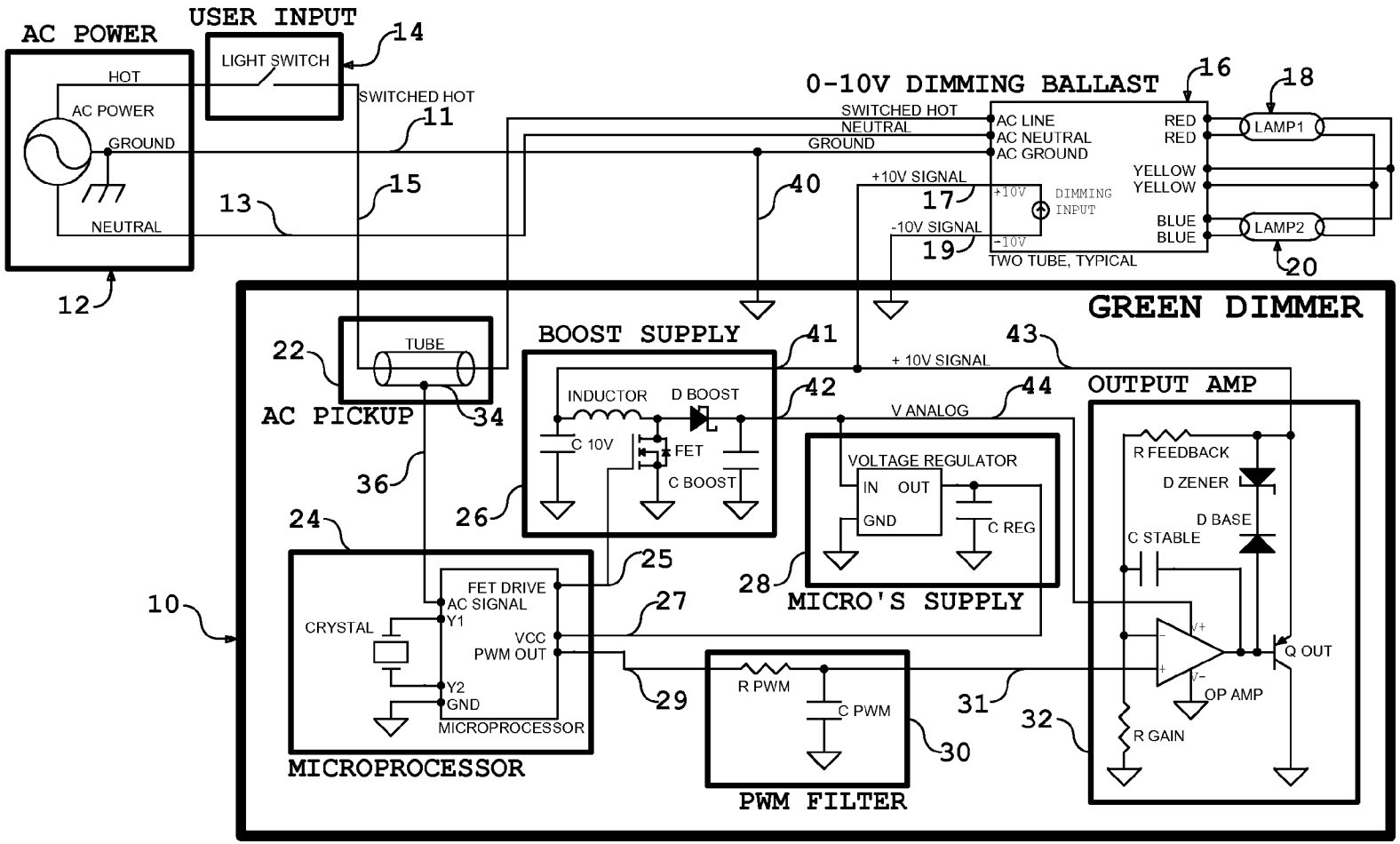
FIG. 1 is a schematic diagram illustrating a presently preferred embodiment of a fluorescent lamp dimming device and system in accordance with the present invention.

Referring now to FIG. 1 of the drawing, a presently preferred embodiment of a fluorescent lamp dimming apparatus and system in accordance with the present invention is depicted including an electronic control device (hereinafter "Controller") shown at 10 along with an AC Power source 12, a User Input switch 14, a 0-10 Volt Dimming Ballast 16, and a pair of fluorescent Lamps 18 and 20. The AC Power source 12 is provided by the conventional input power lines normally connected to a home or office building, and the connection from switch to lamp fixture normally includes "ground", "neutral" and "hot" lines 11, 13 and 15 respectively. Power line sources typically provide power at 120 or 277 volt 60 Hertz.

The User Input switch 14 is typically a standard 2-way (ON/OFF), 3-way or 4-way wall switch for permitting a user to selectively apply power to one or more fluorescent lamp fixtures.

Ballast 16 is a standard 0-10 volt Dimming Ballast typically including "switched hot", "neutral" and "ground" terminals, a +10 V (volt) Signal terminal 17, a −10 V (volt) Signal terminal 19 (usually grounded), and a plurality of output terminals "Red", "Yellow" and "Blue" for connection to end connectors provided on the ends of a pair of fluorescent lamps 18 and 20. As illustrated, and as will be further explained below, the internal dimming control circuit of Ballast 16 acts as a current source developing a +10V Signal at its dimming control input terminal 17. Adjustment of the voltage developed at terminal 17 causes the Ballast to change the power level or frequency applied to the lamps. In accordance with the present invention, the current generated by the Ballast at the control terminal is used to power Controller 10 and be pulled down by Controller 10 to provide a lamp level control input to the Ballast.

The commonly available 0-10V Dimming Ballast 16 sources current (130 uA for example) from its 0-10V dimming control input 17. A controller such as the Controller 10 will command the light level output of Ballast 16 and regulate the voltage on terminal 17 to the desired value by sinking current to ground. One volt, or less, developed at terminal 17 commands minimum light output, 10 volts or more commands maximum light output, and there may be deadbands at minimum and maximum ends of the control range. For example, the dimming ballast may linearly change light level between minimum at 1.0V and maximum at 7.53, with 7.54 to 10V having the same maximum light output.

Although numerous types of dimming ballasts may be used in accordance with the present invention, specific examples of suitable ballasts include the Advance Mark 7 0-10 volt electronic dimmers manufactured by Philips Lighting Electronics N.A. of Rosemont, Ill. under part numbers ADV-IZT2S32SC35I for 2 Lamps, ADV-IZT3S32SC35I for 3 Lamps, and ADV-IZT-4S32 for 4 lamps. Examples of lamps suitable for use with the above dimmers include the types F17T8, F25T8 and/or F32T8.

As shown in FIG. 1, the Controller 10 includes an AC voltage Pickup 22, a Microprocessor 24, a Boost Supply circuit 26, a voltage regulator (Micro Supply) 28, a pulse width modulation (PWM) Filter 30 and an Output Amplifier 32, all of which are mounted on and carried by a suitable PC board or the like (not shown). Alternatively, these circuit components and/or the functions thereof could be presented in other electronic device formats.

The AC voltage Pickup 22 includes, in one embodiment, a short length of metal tubing 34, preferably of brass, about 74 mm in length and having an inside diameter large enough to allow the 18 APM gauge insulated power wire 15 to be threaded therethrough. The tube 34 forms a part of the Controller 10 and is suitably affixed to the PC board carrying the above mentioned electronic components. An output lead 36 is conductively affixed thereto, as by soldering for example, to connect tube 34 to the AC Signal input terminal of Microprocessor 24.

More specifically, the insulated Switched Hot wire 15 fed through tube 34 forms a capacitive Pickup used by Controller 10 to detect the AC Power voltage present on Hot wire 15 when the light Switch 14 is turned ON, and the absence of AC Power voltage on Hot wire 15 when the light switch is turned OFF. The brass tube 34 forms one plate of the capacitive pickup and the Switched Hot wire 15 forms the other plate of the capacitor, with the insulation on the wire 15 and any air gap therebetween acting as the dielectric of the capacitor. The internal ground of Controller 10 is hooked to earth ground to complete the capacitive AC Pickup circuit between Hot wire 15 and earth ground. However, it is important to note that Controller 10 does not make direct electrical contact with either the Hot wire 15 or the Neutral wire 13. The ballast's 0-10V Dimming Input terminal 17 is also electrically isolated from the Hot and Neutral wires, so the wiring connected between Controller 10 and the Ballast is Class 2, as are the circuits inside Controller 10. Accordingly, Controller 10 does not require U/L approval.

Microprocessor 24 is, in the illustrated embodiment, an MSP430F2001 low power embedded controller manufactured by Texas Instruments and, as shown, includes an AC Signal input terminal connected to pickup line 36, an FET Drive signal output terminal connected to an output line 25, a Vcc terminal connected to a power input line 27, and a PWM Out terminal connected to an output line 29 that is connected to the RC filter 30. Operational timing for the processor is determined by a 32 kHz crystal oscillator connected across pins Y1 and Y2.

Boost Supply 26 is a typical inductor/FET/Schottky diode boost circuit of the type often used to power small DC devices from a two cell battery pack. It also includes a pair of storage capacitors C10V and C Boost. In this embodiment, the circuit has its FET gate connected via line 25 to the FET Drive signal terminal of Microprocessor 24 and its power input terminal 41 connected to the +10 V Signal terminal of Ballast 16 via line 40. The circuit is used to develop an output voltage at its output terminal 42 providing, via V Analog line 44, a V+ input to amplifier 32, and providing a power input to voltage regulator 28 which, via line 27, provides a 2.5 volt Vcc input to Microprocessor 24.

Microprocessor 24 requires a constant 2.5V for correct operation. This is provided by the "Micro's Supply" circuit 28 which is composed of a linear Voltage Regulator and associated stability capacitor C Reg. These components are selected according to well known linear power supply equations.

Filter 30 is an RC filter that converts the PWM Out signals generated by Microprocessor 24 to a DC voltage for input via line 31 to the control input of Output Amp 32.

Output Amp 32 includes an operational amplifier circuit that is responsive to the DC voltage developed on lines 31, and is operative to pull down the voltage at the +10V Signal input to Ballast 16 to a corresponding dimming control voltage developed at the output of Filter 30.

Figure 2:
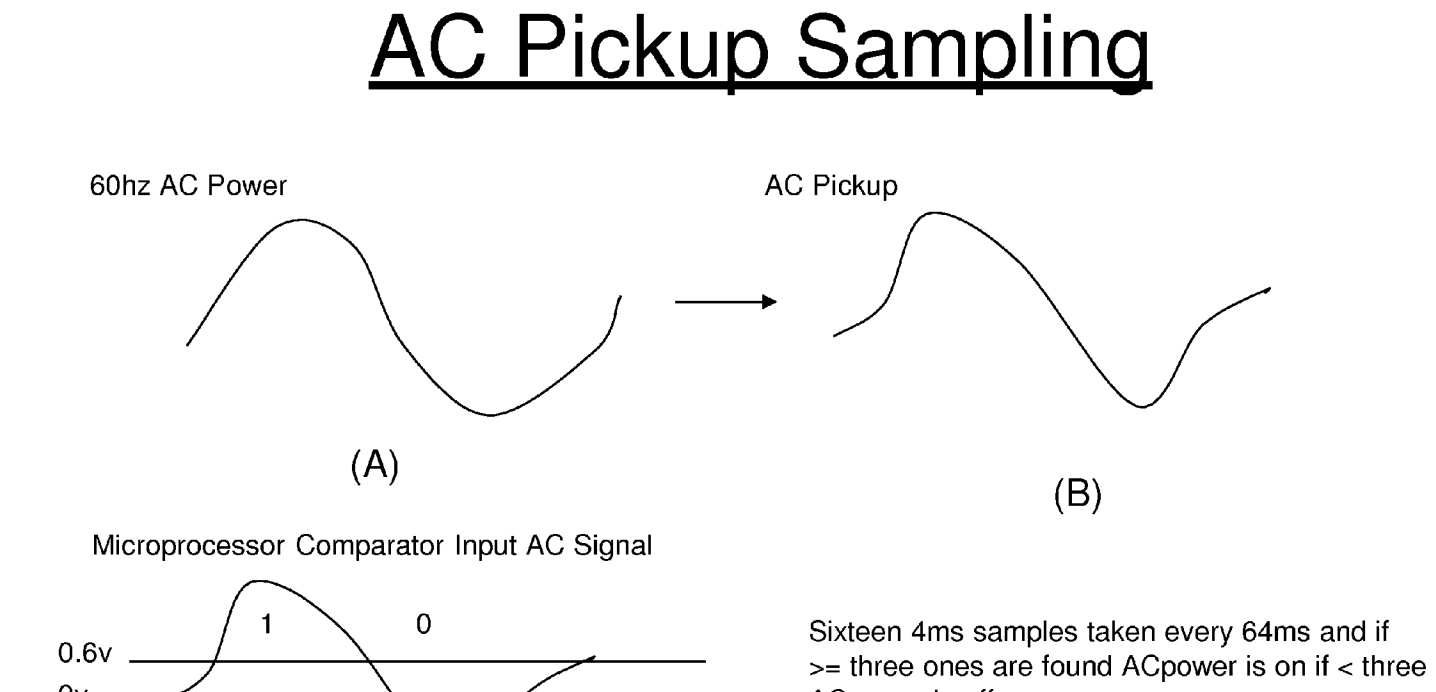
FIG. 2 is a diagram illustrating AC voltage pickup sampling in the embodiment of FIG. 1.

In operation, it will be understood by those skilled in the art that since the power signal on Hot line 15 is a line frequency sine wave such as that depicted at (A) in FIG. 2, the output of AC Pickup 22 will also be a line frequency signal having a waveform such as that depicted at (B) in FIG. 2, but will have a substantially lower voltage (approximately 1 volt) than line voltage. This signal is fed into a comparator (not shown) built into Microprocessor 24 and, as can be seen in part (C) of FIG. 2, rises above the comparator's O.625 volt threshold for positive AC Power voltage excursions, and is less than the comparator's threshold for negative AC Power voltage swings.

In the illustrated embodiment, Microprocessor 24 samples its comparator input every 4 ms, which is frequently enough to capture at least one positive sample every positive cycle of the AC pickup's output. A running buffer of 16 samples of the comparator is continuously examined by the Microprocessor which in response determines that the power on line 15 is ON if it sees at least three positive samples, or is OFF if it sees less than three positive samples. These values are chosen to reject noise while the light switch is OFF, without missing the AC while the switch is ON.

The Boost Supply 26 and supporting power circuits need to provide enough power to the Microprocessor when the AC power is OFF due to a wall switch toggle to keep the micro alive for up to 4 seconds. To do this the microprocessor code detects the absence of power and immediately causes the processor to go into a low power state and only exit that state when it detects power again.

As was suggested above, Microprocessor 24 uses a Crystal oscillator to provide sufficiently accurate timing, while taking advantage of low power operation modes that allow the Controller 10 to be powered from the ballast's 0-10V Dimming Input signal available at Ballast terminal 17. Microprocessor 24 is programmed to spend most of its time in a low power "sleep" mode with the program halted, and to wake up to a higher power operational mode every 4 ms to execute its program. The low power sleep mode draws less current than is available from Ballast 16, while the high power operational mode draws more current than is available from the Ballast. According to the present invention, the average power consumption of the two modes is selected to be less than the available power available from the Ballast.

Microprocessor 24 does not have a digital-to-analog converter built in (to save money and reduce power consumption). Thus Controller 10 uses a Pulse Width Modulation (PWM) output developed at terminal PWM Out and filtered by the PWM Filter 30 to selectively create, in response to the user's switch flicking input, an analog control voltage in the range of from 0.303V to 2.500V, to which the Output Amp 32 responds and pulls voltage at the ballast control terminal 17 to a corresponding light level setting in the ballast control range of from 1.28V to 10V.

Figure 3:
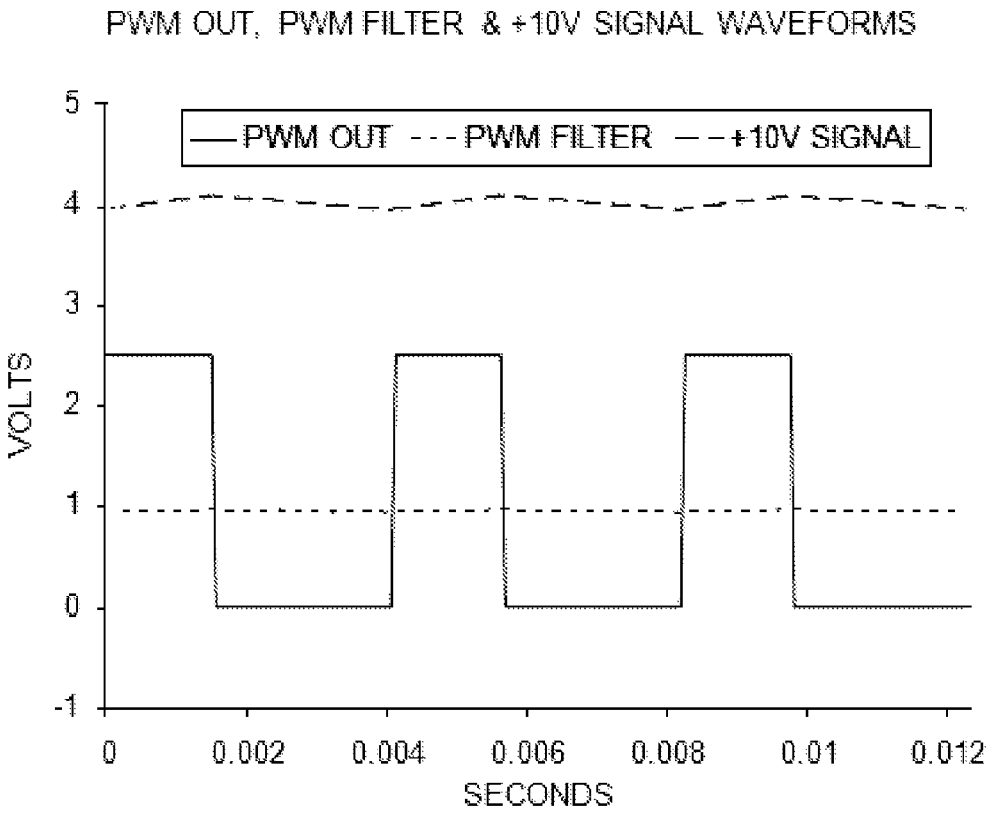
FIG. 3 is a diagram illustrating signal waveforms appearing in the embodiment of FIG. 1.

Note that Filter 30 is composed of a resistance component "R PWM" and a capacitance component "C PWM" which are connected to form a well known RC low pass filter that turns the 2.5V variable duty cycle square wave signal developed by Microprocessor 24 at its PWM Out pin into a DC voltage with a sufficiently small PWM frequency ripple. The ripple must be limited to avoid wasting current from the ballast Dimming control input at terminal 17. An example of the PWM Out pulses, the filtered signal and the corresponding ballast control voltage for a particular Dim setting is shown in FIG. 3.

The 1.28 V to 2.5 V output of the PWM Filter 30 is fed to the positive input terminal of the device's "Op Amp" in the Output Amp 32 which acts as a non-inverting amplifier with a gain of 4.24. The gain is set by the resistors "R Feedback" and "R Gain" according to well known non-inverting op amp equations. This gain is selected (accounting for component tolerances) to assure that it is able to command the full 10V to the dimming Ballast 16.

Output Amp 32 drives the circuit's "Q Out" transistor in the well known non-inverting PNP emitter follower configuration to allow the Op Amp to regulate "+10V Signal" ballast control voltages that are above its V Analog power supply rail V+. This is necessary for operation at startup and some light levels. A transistor that only sinks current works in this case because the ballast's input always sources current. The amplifier's "D Zener" and "D Base" are required to clamp the voltage between Q Out's base and emitter to levels that do not exceed Q Out's reverse base-to-emitter specification of typically 5V, which could otherwise occur during a transient condition if the Op Amp's output were allowed to reach its V Analog power supply voltage (10V maximum) while the ballast's +10V Signal is still increasing from a much lower level, such as 1.28V.

The diode D Base is required to prevent D Zener from forward biasing and clamping the +10V Signal to the Op Amp's output voltage. D Zener's break over voltage (added to the series forward voltage drop of D Base) is selected to be less than Q Out's reverse base-to-emitter specification. The capacitor "C Stable" is selected according to well known op amp compensation techniques to slow down the regulation of the Op Amp's closed loop amplification and avoid oscillation caused by the slow rise time of the +10V Signal. Oscillation must be avoided because it can consume more power than is available from the ballast's Dimming input.

Ballast 16 quickly stops providing current from its Dimming input terminal 17 when the Light Switch is turned OFF following a flick of switch 14 from its ON and OFF positions. However, when Controller 10 is regulating the +10V Signal to voltages above 3.5V, Boost Supply 26 still supplies sufficient V Analog supply voltage for correct operation of the Microprocessor 24 and the Output Amp 32, due to the energy stored in the capacitor "C Boost" of Boost Supply 26, and is thus capable of riding out the OFF period of the switch flicks. For operation below 3.5V, Controller 10 uses the device's "Boost Supply" circuit to convert the Ballast's +10V Signal to a suitably higher voltage on the V Analog power supply line 43. The capacitor "C 10V" in Boost Supply 26 is used to smooth ripple on the +10V Signal from the discontinuous operation of the Boost Supply when it is used.

When boosting is required, Microprocessor 24 outputs every 4 milliseconds a 150 microsecond 2.5V logic high FET Drive pulse to the gate of the circuit's "FET" to short the Boost circuit's "Inductor" to ground. The Inductor value is selected according to well known switching power supply design equations to not saturate or draw enough current from C 10V to cause excessive ripple on the +10V Signal for the FET Signal's pulse's ON duration. The length of the FET Drive pulse must be short enough not to slow down the higher power operational mode of the microprocessor but not so short as to increase power lost driving the FET's gate by requiring more frequent switching. The current flowing through the Inductor at the end of the FET Drive pulse will continue to flow when the FET Drive signal goes low and turns OFF the FET. At this point the Inductor current flows through D Boost into C Boost until the stored magnetic energy in the Inductor is transferred into voltage on C Boost.

D Boost and C Boost are selected according to well known switching power supply equations. For +10V Signal levels of 2 volts and below, Microprocessor 24 issues multiple FET Drive pulses separated by 80 microsecond OFF periods that allow the inductor to substantially discharge. The lower the +10V Signal value, the more pulses it generates; up to 4 maximum per 4 millisecond sleep/wake cycle. The number of pulses is chosen to be enough to exceed 3.5V on C Boost without being so many that it pulls more power from the Ballast than is available.

The following Dimming Transfer Function Table provide a map between Dim Level and the software's 0-66 dim level number, voltage out of the PWM filter, the +10V output, number of FET drive pulses ballast power consumption and % light output.

DIMMING TRANSFER FUNCTIONS

| DIM LEVEL | MICRO PWM# | PWM FILTER VOLTS | +10 V SIGNAL VOLTS | V Analog VOLTS | FET drive Pulses | BALLAST AC POWER WATTS | BALLAST LIGHT OUT |
|---|---|---|---|---|---|---|---|
| 1 | 8 | 0.303 | 1.28 | 2.90 | 4 | 26% | 11% |
| 2 | 10 | 0.379 | 1.61 | 3.70 | 3 | 31% | 16% |
| 3 | 13 | 0.492 | 2.09 | 5.00 | 2 | 37% | 23% |
| 4 | 19 | 0.720 | 3.05 | 5.70 | 1 | 49% | 37% |
| 5 | 25 | 0.947 | 4.02 | 3.62 | 0 | 61% | 51% |
| 6 | 32 | 1.212 | 5.14 | 4.74 | 0 | 73% | 67% |
| 7 | 40 | 1.515 | 6.42 | 6.02 | 0 | 87% | 84% |
| 8 | 66 | 2.500 | 10.00 | 9.60 | 0 | 100% | 100% |

Having thus described the hardware aspects of Controller 10, it will be appreciated that four signals provide the interface between the software embedded in Microprocessor 24 and the illustrated hardware. These signals include the AC Signal input from Pickup 22 on line 36, the FET Drive signal output on line 25, the 32 kHz input to processor pins Y1 and Y2 by the Crystal Osc, and the PWM Out signal generated on line 29.

As discussed above, the Controller 10 regulates the voltage on the Dimming Ballast's 0-10V Dimming Input terminal 17 to command the Ballast to a user set light level. The Controller 10 also derives its operating power from the current supplied by the ballast's 0-10V Dimming Input at terminal 17.

With the lights ON, a user desiring to adjust the light output of the fluorescent lamps can simply manipulate the Light Switch 14 a series of brief switch "flicks" turning OFF the switch and then turning it back on. The series of flicks starts with the light switch ON and ends with the light switch ON. The OFF/ON flicks must be longer than 100 ms and shorter than one second to be detected by Controller 10 as part of a flick sequence. The switch manipulation is acted upon by Controller 10 when the light switch is left ON for more than a second. No action is taken if the switch is turned OFF for more than a second. OFF for more than a second is treated as simply a turning OFF of the lights.

Responding to the AC line voltage (depicted at (A) in FIG. 2), the AC signal voltage depicted at (B) in FIG. 2 and developed by pickup 34 on the AC Drive pin is fed into a comparator input within the processor 24, and as illustrated at (C) of FIG. 2, the comparator takes 16 4 ms samples every 64 ms generates a "1" value if the voltage is greater than a 0.625 volt reference; otherwise a "0" value is generated. A value of "1" indicates line voltage is present on the switched "hot" line 15. If three or more 1's are detected in any 16 cycle sample period, a determination is made that the AC power is present on line 15, i.e., switch 14 is in the ON position. If less than three 1's are detected during the sample period, it is determined that switch 14 is in the OFF position.

The FET drive signal is an output voltage developed on the FET DRIVE pin of processor 24. The processor software monitors the PWM output duty cycle value for the lower dimming levels and sets and resets the FET DRIVE output to generate a series of 1, 2, 3 or 4 pulses of various ON and OFF times on line 25. The number and duration of the pulses is based on the amount of power boost needed from boost circuit 26 to maintain a voltage at circuit node 42 sufficient to allow regulator 28 to hold processor pin Vcc at 2.5 volts. The ON and OFF pulse times are typically 150 microseconds ON and 80 microseconds OFF.

The signal generated at the PWM Output pin of the processor 24 is a pulse width modulated voltage generated from two timers within the microprocessor. One of the timers sets the period and the other sets the duty cycle. The period is 4 milliseconds and the duty cycle varies based on the 0-10 v dimming voltage set by the user by toggling the switch 14. The 32 kHz crystal is used to set the 4 millisecond time base used. Internal to the microprocessor, the 32 kHz signal is divided by 2, and 66 cycles at this frequency sets the 4 millisecond interrupt used to run the software as described below.

The software written for the processor 24 has five basic functions, namely:

1. Sensing power OFF/ON cycles from the AC SIGNAL input from the AC pickup device 22. The number and timing of these OFF/ON cycles control the ballast dimming levels.
2. Setting the PWM OUT signal's period and duty cycle using a pulse width modulation (PWM) technique to develop a pulse width modulated pulse train that can be used to set the 0-10 v output ballast dimming signal voltage
3. Controlling the power boost circuit by opening and closing the Inductor Boost FET device for precise times via the FET DRIVE output when the 0-10 v dimming output is at low voltage levels.
4. Minimizing the processor current requirement, and
5. Saving the dimming settings in the processor's flash memory.

Figure 4:
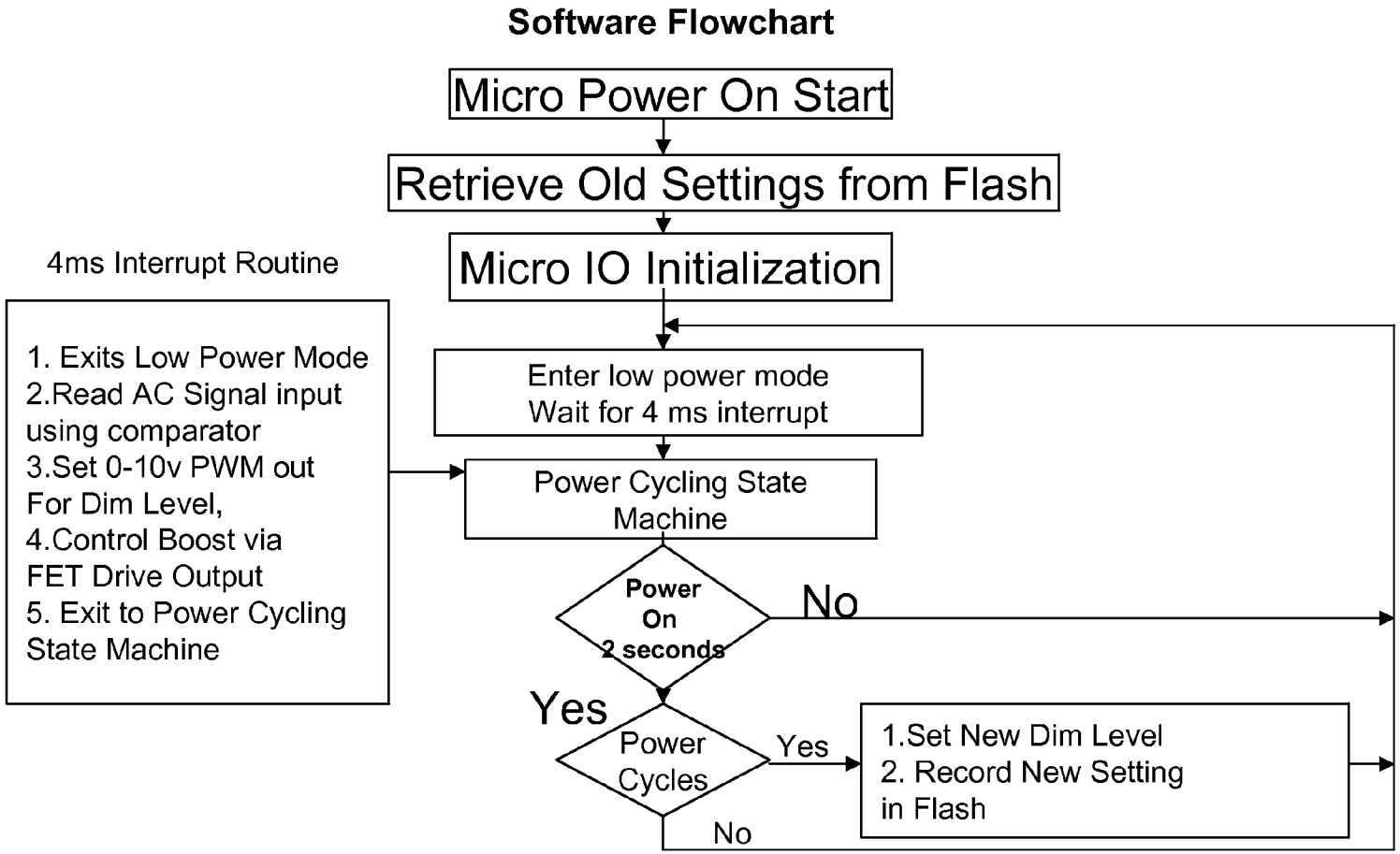
FIG. 4 is a software flowchart illustrating operation of the microprocessor shown in the embodiment of FIG. 1.
Figure 5:
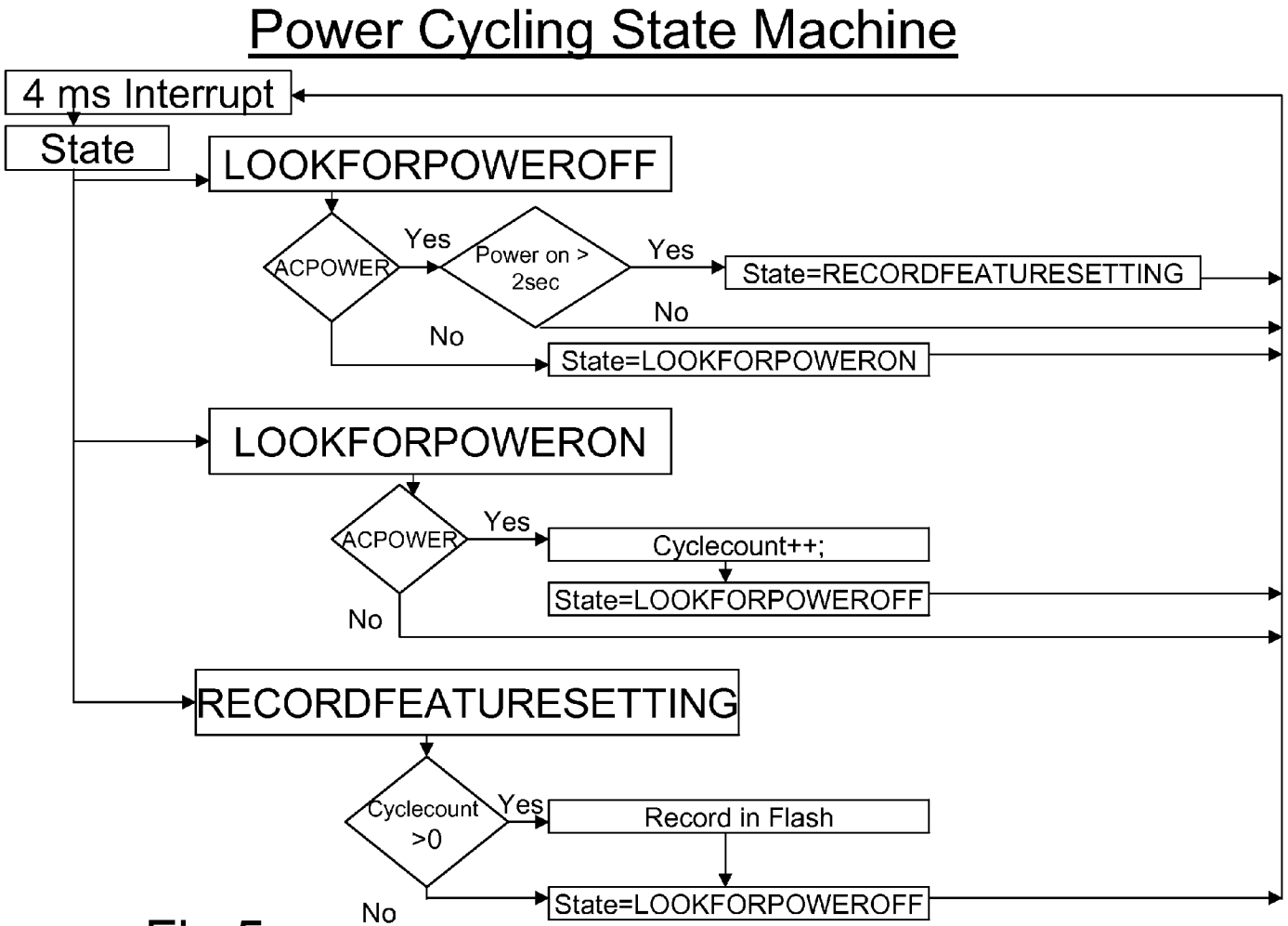
FIG. 5 is a flowchart illustrating a power cycling state machine implemented in the embodiment of FIG. 1.

In operation, and as illustrated by the flow diagram of FIG. 4, the software runs in continuous 4 millisecond loops. The external 32 kHz crystal oscillator is used to generate the 4 millisecond time interval. During each such interval the following actions occur:

1. The 4 millisecond interrupt routine is executed when the 4 millisecond timer expires and generates an interrupt. The interrupt causes the low power processor mode to be exited and the processor runs at 100 kilohertz.
2. The AC SIGNAL voltage level is sampled to detect whether the power on line 15 is ON or OFF. 16 such consecutive samples over a period of 64 milliseconds are used to detect the presence or absence of AC power to the ballast. Greater than or equal to 3 positive voltage samples within the 16 samples indicates that 50 or 60 hertz power is present.
3. The Inductor D BOOST circuit 26 is refreshed using the FET DRIVE output according to the 0-10 v signal level to keep the input to the processor's VOLTAGE REGULATOR circuit 28 above 2.5 volts.
4. The PWM out period and duty cycle are set using the microprocessor timer control registers.
5. The interrupt service routine is exited and the Power Cycling state machine depicted in the flow diagram of FIG. 5 begins execution.
6. The state machine is executed to detect power OFF/ON cycles and count the number of consecutive cycles that occur within each 2 seconds interval. When 2 seconds has elapsed with power ON, the previous OFF/ON cycle count is used to set the dimming level selected by the user.
7. After completing steps 2 through 6, the processor is placed in a low power mode and remains in this mode until the next 4 millisecond interrupt occurs.

The above described embodiment of the control device 10 is implemented with all components mounted on a small (approximately 74 mm×34 mm) printed circuit board encased in a suitable housing. In an alternative embodiment, the component parts of the control device 10 are integrated into the dimming ballast making use of the ballast's low voltage DC power supply and simplifying the 0-10V circuitry.

Furthermore, as used in this application, the terms "processor", "signal processor" and "microprocessor" are intended to mean or include functionally equivalent logic means such as ASICs, PALs, discrete logic circuitry, EPROMs or other logic devices.

The Controller 10 will work with a standard toggle light switch or a rotary switch. The standard toggle light switch simply turns power on and off when toggled and the Controller 10 decodes the number or duration of the cycles to change the dimming as described in the Operation section. The wall mounted rotary switch supplies power to the fixture when pressed in and raises the dimming level when rotated clockwise and lowers it when rotated counterclockwise.

The switch will have a different timingof power contacts when rotated in one direction from the other.

The Controller 10 operates in seven primary ways, namely:

1. Fixture power is applied when the light Switch 14 is turned ON. This causes the AC line Voltage to be detected by Controller 10. Microprocessor 24 in turn sets the 0-10 v dimming control output at terminal 17 to the previous level as retrieved from its internal non volatile memory circuits. Alternative implementations may be set to not remember the user's previously set light level and to always start at a pre-programmed level that the user may only override until the next time the lights are left OFF for more than some period of time.
2. With the lights turned ON, the Microprocessor 24 continuously monitors the AC line voltage state to detect subsequent OFF/ON power cycles. A new dimming level can then be set by manipulation of the light Switch 14. For example, by flicking the switch through a number of OFF/ON cycles within a limited time (e.g., 4 seconds). Alternatively, the program can be modified to detect a particular cadence of turning the light switch OFF/ON, or the time in which power is OFF or ON. The controller program can be set such that the number of power cycles within a predefined time period will control the dimming in any of the following ways.

a. Two successive power cycles might indicate that the light level is to be increased one level while one power cycle might indicate that the light level is to be reduced one level.
b. A particular number of cycles in a given time might indicate that the light level is to be set at a particular one of 8 levels.

Moreover, the elapsed time of a single power cycle OFF might alternatively be used to indicate a particular direction of change. For example, less time OFF than some reference time might cause an increase in the light level, and more time OFF than the reference time might cause a decrease in the light level.

Furthermore, the power OFF duration might be programmed to set the light level to be directly proportional to the OFF time, at say ½ second per light level for example. Or the rapidity of toggling the light level might be used to change the light level. For example, a series of fast toggles might increase the light level by one step and a series of slow toggles might decrease the light level by one step.

Typically, when the lower or upper levels are reached, additional power cycle sequences that would normally increase or decrease the level beyond the limits will be ignored. This assures that multiple dimmers can be synchronized.

Alternatively, the light level can be programmed to roll over between maximum and minimum. This allows each OFF/ON toggle of any short duration to always change the light level by one step. Increasing or decreasing steps may also be used; with the user toggling the light till the desired level is reached even if it requires rolling over between light level extremes.

The dimmer can also be programmed by light switch manipulation to set its maximum light level command to be less than the ballast's maximum light level. This is typically done by a secret pattern of light switch manipulations that cause the present light level command to be memorized as the maximum allowed or reset to the maximum possible. This can be used to reduce energy consumption even if the user does not take advantage of the dimming capabilities, for example.

3. When the microprocessor detects that the power line frequency has dropped from 60 Hertz to 59 hertz or some other predetermined value for some time period, the lights are automatically dimmed to a preset level for power savings. This is a method by which the naturally occurring drop in frequency that can occur during brownouts or can be deliberately introduced by power utilities can be used to signal participating customers to shed some power in times of excessive energy demand. The light level may be reduced from the present value by a number of steps, or the maximum allowed light level may be limited and the light level reduced only if it was commanded to a higher value. The light level cap or reduction may last only as long as the line frequency is reduced, or for an additional time after recovery.
4. When multiple Controllers are connected to the same light switch they may see different numbers of power cycles. To allow for resynching of the Controllers, the Controllers can hold at the maximum or minimum light levels even when the light switch attempts to increase or decrease the light level beyond the maximum or below the minimum levels.
5. For implementations powered by the Ballast's 0-10V input, a lower cost implementation can be achieved if the light level will never be set to a level lower than a minimum voltage required to power the Microprocessor through a linear regulator, 3 volts for example. Dimming below the minimum setting should be accomplished by leaving the light switch OFF. Alternatively, circuit components can be added to increase the voltage to the microprocessor such that lower light levels can be commanded.
6. The dimming level can never be commanded low enough to cause the fluorescent lights to go OFF. The lights will remain OFF when the light switch is set to the OFF position for greater than the dimming change time period. This will prevent a potential safety issue to be caused by the controller.
7. Controller models may be designed with installer adjustable switches that allow turning ON or OFF various features. For example, in some locations detection of the dropping to 59 Hertz from 60 Hertz may not be desirable. Another example would be a switch that tells the Controller to retrieve and apply the last light dimming setting during an initial power-on. An alternative adjustment method would be to enable different features by signaling to the Microprocessor via a particular light switch toggling sequence. This has the added advantage of being something the customer could do to change features without having to access the fixture to get to the dimmer switches.

The above illustrated tube version (FIG. 1) of the non-contact capacitive AC Sensor is the preferred implementation because:

1. It does not require hooking the Controller to the high voltage AC Power. This eliminates potential shock and fire hazards;
2. It senses line voltage, not line current. Line voltage is always present when the light switch is turned ON. Sensing current can be more difficult when powering a single ballast on a 277V system that draws very little current during the pre-heat phase of lamp starting;
3. There is less wiring to connect together because the Hot wire is passed through a tube instead of requiring a physical connection; and
4. A tube positively locates the wire and maximizes capacitance by assuring a small gap between the wire and the tube wall and by surrounding the wire with the sensor. A PCB trace non-contact capacitive sensor would offer less capacitance and less repeatability.

Figure 6:
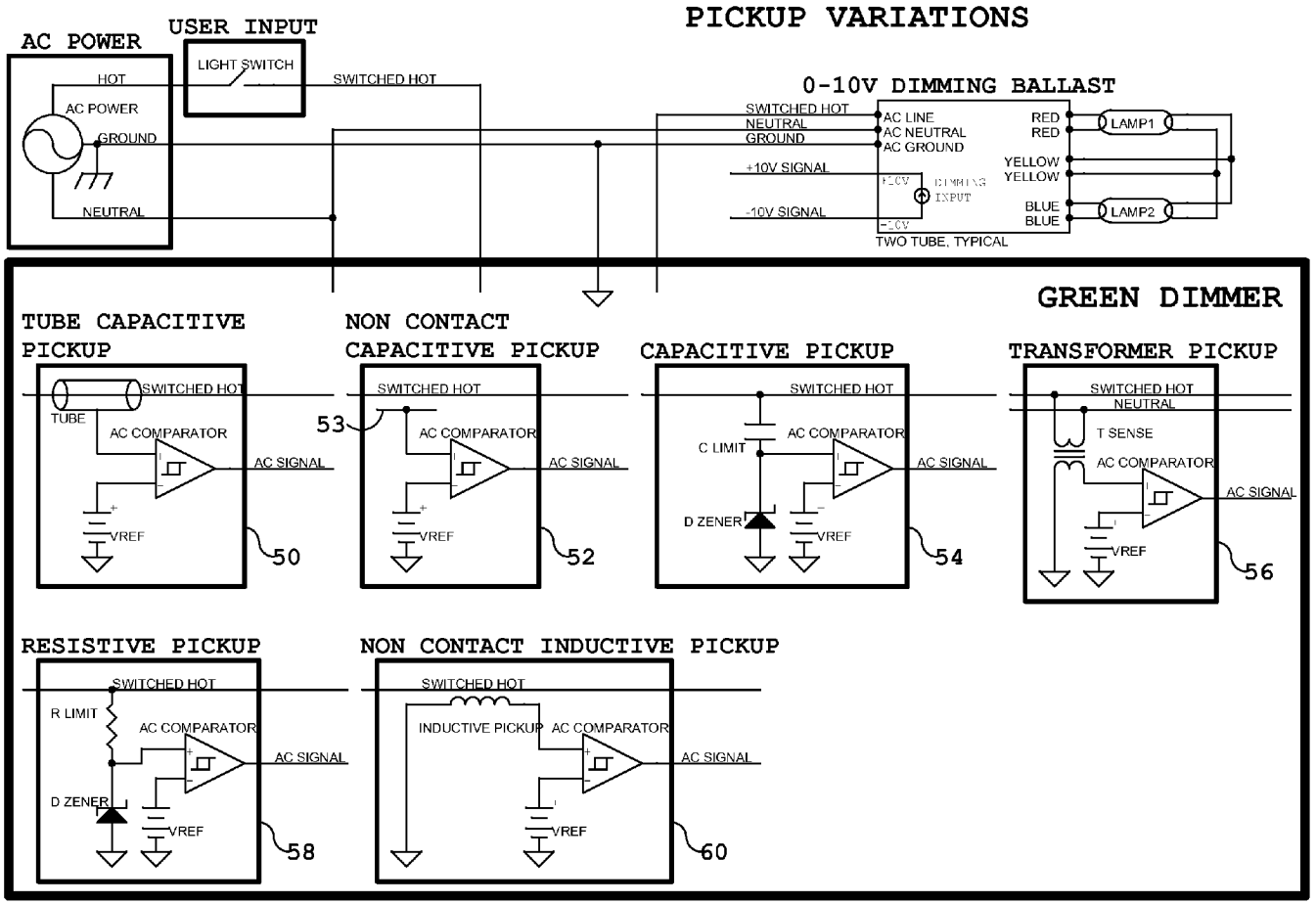
FIG. 6 is a diagram illustrating alternative embodiments of AC voltage pickup devices that might be used in the present invention.

However, a number of alternative Pickup alternatives are available as illustrated in FIG. 6. In this figure the included "AC Comparator" and "VREF" components are part of the Microprocessor and are broken out to show their function.

Tube Capacitive Pickup 50

This is the brass tube embodiment described in the above functional description of the preferred embodiment.

Non Contact Capacitive Pickup 52

This is a capacitive pickup similar to the TUBE CAPACITIVE PICKUP 50 except that the tube is replaced by a sensing element that does not enclose the Switched Hot wire, but instead is a plate lying parallel to the wire. For example, the Switched Hot wire might be laid on top of a PCB trace 53. This technique provides less signal level than the TUBE CAPACITIVE PICKUP method and requires some means of assuring the Switched Hot wire is properly positioned with respect to the sensing element 53.

Capacitive Pickup 54

A discrete "C Limit" capacitor is connected to the Switched Hot wire. "D Zener" is used to limit the voltage at the AC Comparator's+pin to non destructive values. C Limit acts as a reactive current limiter to prevent damaging D Zener. C Limit and D Zener are selected to limit power dissipation to a desired value. Unlike the TUBE CAPACITIVE PICKUP 50, an electrical connection to the Switched Hot wire is required which results in safety issues that are potentially problematic.

Transformer Pickup 56

A "T Sense" transformer steps down the high voltage Switched Hot AC signal to a low voltage signal within the AC Comparator's operational range. The T Sense transformer also provides galvanic isolation from the Switched Hot potential. This method is typically more expensive than the TUBE CAPACITIVE PICKUP method and requires connection to the Switched Hot wire and the Neutral wire which results in safety issues that are potentially problematic.

Resistive Pickup 58

A discrete "R Limit" resistor is connected to the Switched Hot wire. "D Zener" is used to limit the voltage at the AC Comparator's+pin to non destructive values. R Limit acts as a current limiter to prevent damaging D Zener. R Limit and D Zener are selected to limit power dissipation to a desired value. Unlike the TUBE CAPACITIVE PICKUP, an electrical connection to the Switched Hot wire is required which results in safety issues that are potentially problematic.

Non Contact Inductive Pickup 60

An "Inductive Pickup" is clamped around the Switched Hot wire. The current in the Switched Hot wire is detected by the comparator. This method is typically more expensive than the TUBE CAPACITIVE PICKUP and is more difficult to implement because some ballasts do not immediately draw significant current after power is applied which makes it more difficult to reliably detect when the Light Switch is turned back ON.

Having thus illustrated and described what is presently believed to be the best mode of practicing the invention, it is anticipated that those skilled in the art may envision other variations an alternatives to those described and/or suggested above. It is therefore intended that this disclosure not be considered as limiting and that the appended claims be interpreted as covering all embodiments within the true spirit and scope of the invention.

What is claimed is:

1. A fluorescent lighting system including at least one fluorescent lamp, a dimming ballast for powering the lamp, a user operated switch for selectively connecting the ballast to a source of electrical power, and a ballast controller, the dimming ballast having powered dimming control signal input terminals for receiving a dimming control command from the ballast controller and being operative to adjust the power applied to the lamp from the power source through the switch and a connecting power carrying conductor, the ballast controller comprising:

a sensor for sensing electrical power present on said connecting conductor and for developing a corresponding sense signal;

a microprocessor responsive to said sense signal and operative to detect interruptions of power present on said connecting conductor caused by at least one change of state of the electrical power present on said connecting conductor, and to develop a corresponding control signal; and circuit means connected to the control signal input terminals of the ballast, and operative to extract power therefrom to power said microprocessor, said circuit means being further operative to use said control signal to command the ballast to change the power applied to the lamp.

2. The fluorescent lighting system as recited in claim 1, wherein said sensor is a capacitive device forming one plate of a capacitor, the other plate of the capacitor being formed by said connecting conductor.

3. The fluorescent lighting system as recited in claim 1, wherein said circuit means includes a boost supply component connected to said powered dimming control input terminal and controlled by said microprocessor to extract at least enough power from said ballast to provide operational power for said microprocessor.

4. The fluorescent lighting system as recited in claim 3, wherein said circuit means further includes an output amplifier connected to said powered dimming control input terminal, said output amplifier being responsive to said control signal and operative to command the ballast to change the power applied to the lamp.

5. The fluorescent lighting system as recited in claim 4, wherein said corresponding control signal is a pulse width modulated signal and said circuit means further includes a filter for converting the pulse width modulated signal to a DC signal for driving said output amplifier.

6. The fluorescent lighting system as recited in claim 3, wherein said circuit means further includes a voltage regulator for causing the operational power applied to said microprocessor to have an appropriate voltage level for powering said microprocessor[or other circuitry].

7. The fluorescent lighting system as recited in claim 3 wherein said boost supply component includes an inductor in series with a diode, and a transistor connected the junction therebetween, said transistor being responsive to a signal developed by said microprocessor and operative to temporarily short the junction to circuit ground.

8. The fluorescent lighting system as recited in claim 7, wherein said boost supply component further includes an energy storage element connected between said powered input terminal and the side of said inductor opposite said junction, and circuit ground.

9. The fluorescent lighting system as recited in claim 7, wherein said boost supply component further includes an energy storage element connected between the side of said diode opposite said junction, and circuit ground.

10. A controller for sensing electrical power present on a conductor carrying AC power and for developing a corresponding control signal for input to the powered dimming control signal input terminals of a dimming ballast connected to a power source by the conductor and a power switch to power at least one fluorescent lamp, comprising:

a sensor for sensing electrical power present on the conductor and for developing a corresponding sense signal;

a microprocessor responsive to said sense signal and operative to detect interruptions of power present on the conductor caused by at least one change of state of the AC power present on the conductor, and to develop a corresponding control signal; and circuit means for connection to the powered dimming control signal input terminals of the ballast, and operative to extract power therefrom to power said microprocessor, said circuit means being further operative to use said control signal to develop a command signal for input to the dimming control signal input terminals to change the power applied to the lamp.

11. The controller for sensing electrical power present on a conductor carrying AC power as recited in claim 10, wherein said sensor is a capacitive device forming one plate of a capacitor, the other plate of the capacitor being formed by the conductor carrying AC power.

12. The controller for sensing electrical power present on a conductor carrying AC power as recited in claim 10, wherein said circuit means includes a boost supply component for connection to the powered dimming control terminal, said boost supply component being controlled by said microprocessor or other circuitry to extract at least enough power from the powered dimming control signal input terminals to provide operational power for said microprocessor.

13. The controller for sensing electrical power present on a conductor carrying AC power as recited in claim 12, wherein said circuit means further includes an output amplifier for connection to said powered dimming control signal input terminals, said output amplifier being responsive to said control signal and operative to develop an output for commanding the ballast to change the power applied to the lamp.

14. The controller for sensing electrical power present on a conductor carrying AC power as recited in claim 13, wherein said corresponding control signal is a pulse width modulated signal and said circuit means further includes a filter for converting the pulse width modulated signal to a DC signal for driving said output amplifier.

15. The controller for sensing electrical power present on a conductor carrying AC power as recited in claim 12, wherein said circuit means further includes a voltage regulator for causing the operational power applied to said microprocessor to have an appropriate voltage level for powering said microprocessor or other circuitry.

16. The controller for sensing electrical power present on a conductor carrying AC power as recited in claim 12, wherein said boost supply component includes an inductor in series with a diode, and a transistor connected to the junction therebetween, said transistor be responsive to a signal developed by said microprocessor and operative to temporarily short the junction to circuit ground.

17. The controller for sensing electrical power present on a conductor carrying AC power as recited in claim 16, wherein said boost supply component further includes an energy storage element connected between said powered input terminal and the side of said inductor opposite said junction, and circuit ground.

18. The controller for sensing electrical power present on a conductor carrying AC power as recited in claim 16, wherein said boost supply component further includes an energy storage element connected between the side of said diode opposite said junction, and circuit ground.

19. A method of sensing electrical power present on a conductor carrying AC power and developing a corresponding control signal for adjusting the control voltage at the powered dimming control signal input terminals of a dimming ballast connected to a power source through the conductor and a power switch to power at least one fluorescent lamp, comprising:

sensing electrical power present on the conductor and developing a corresponding sense signal;

monitoring said sense signal to detect interruptions of the power present on the conductor caused by at least one change of state of the AC power present on the conductor, and for developing a corresponding control signal; and extracting power from the powered dimming control signal input terminals of a dimming ballast to enable a signal processor to use said control signal to develop a command signal for input to the dimming control signal input terminals to change the power applied to the lamp.

20. A controller for sensing electrical power present on a conductor carrying AC power and for developing a corresponding control signal for input to the powered dimming control signal input terminals of a dimming ballast connected to a power source by the conductor and a power switch to power at least one fluorescent lamp, comprising:

a sensor for sensing electrical power present on the conductor and for developing a corresponding sense signal;

a signal processor responsive to said sense signal and operative to detect interruptions of power present on the conductor caused by at least one change of state of the AC power present on the conductor, and to develop a corresponding control signal; and circuit means for connection to the powered dimming control signal input terminals of the ballast, and operative to extract power therefrom to power said signal processor, said circuit means being further operative to use said control signal to develop a command signal for input to the dimming control signal input terminals to change the power applied to the lamp.

* * * * *